US006920869B2

(12) United States Patent
Murata et al.

(10) Patent No.: US 6,920,869 B2
(45) Date of Patent: Jul. 26, 2005

(54) V-TYPE ENGINE

(75) Inventors: Shinichi Murata, Okazaki (JP); Masayuki Kamo, Okazaki (JP); Kunitoshi Kajiwara, Chiryu (JP); Daisuke Kitada, Okazaki (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/859,175

(22) Filed: Jun. 3, 2004

(65) Prior Publication Data

US 2005/0011476 A1 Jan. 20, 2005

(30) Foreign Application Priority Data

Jun. 5, 2003 (JP) ..... 2003-160976

(51) Int. Cl.[7] ..... F01B 1/04
(52) U.S. Cl. ..... 123/572; 123/54.4
(58) Field of Search ..... 123/572–574, 123/54.4, 54.8

(56) References Cited

U.S. PATENT DOCUMENTS 4,947,812 A * 8/1990 Inoue et al. ..... 123/193.2
5,069,192 A * 12/1991 Matsumoto et al. ..... 123/572
6,058,901 A * 5/2000 Lee ..... 123/197.1
6,142,129 A * 11/2000 Hori et al. ..... 123/572
6,460,524 B2 * 10/2002 Kimura ..... 123/572

FOREIGN PATENT DOCUMENTS

JP 3-281901 A 12/1991

* cited by examiner

*Primary Examiner*—Marguerite McMahon
(74) *Attorney, Agent, or Firm*—Birch, Stewart, Kolasch & Birch, LLP

(57) ABSTRACT

There is provided a V-type engine, in which deck cylinder parts of a cylinder block are offset in the same direction as a rotational direction of a crankshaft, and oil separation chambers are provided at an upper portion of the cylinder head displaced to a lower side by the offset. Therefore, an allowance in the axial direction of cylinders may be provided above a cylinder head of the deck cylinder parts on the lower side, and the capacity of the oil separation chambers is increased by the allowance so that the oil separation performance may be improved, while an increase in the total width and total height of an engine block is suppressed.

5 Claims, 2 Drawing Sheets

V-TYPE ENGINE

CROSS-REFERENCE TO RELATED APPLICATION

This application incorporates by reference the subject matter of Application No. 2003-160976 filed in Japan on Jun. 5, 2003, on which a priority claim is based under 35 U.S.C. §119(a).

BACKGROUND OF THE INVENTION

1. Field of the Invention

The present invention relates to a V-type engine in which oil separation chambers are provided at upper portion of cylinder heads.

2. Description of the Related Art

In passenger vehicles (or vehicles), a V-type engine is mounted in an engine compartment since it has the advantage that it can be easily mounted although it is a multiple cylinder engine.

The V-type engine is comprised of a cylinder block in which deck cylinder parts are formed on a crankcase in a manner being protruded in V shape, and cylinder heads provided in the respective deck cylinder parts. The reciprocating motion of pistons within cylinders of the respective deck cylinder parts realizes a combustion cycle comprised of an intake stroke, a compression stroke, an explosion stroke, and an exhaust stroke, so that power generated by the pistons can be output from a crankshaft to outside.

In this V-type engine, a crankcase emission control system is used to cause blow-by gas generated inside the V-type engine to flow back so that the blow-by gas may be combusted in each cylinder. On this occasion, if oil content (lubricating oil) in the blow-by gas is combusted, it affects the treatment of exhaust gas, and increases the consumption of lubricating oil. To address this problem, the V-type engine is constructed such that oil separation chambers are provided at upper portion of cylinder heads in at least one of cylinder banks. In general, the oil separation chambers are incorporated in ceilings of rocker covers; if the rocker covers are mounted on the cylinder heads, the oil separation chambers may be mounted at upper portion of the cylinder heads.

By the way, the V-type engine has been required to improve the capability of the oil separation chambers so as to e.g., reduce the consumption of lubricating oil and purify exhaust gas.

For that purpose, the capacity of the oil separation chambers is required to be increased. The V-type engine, however, is mounted in the engine compartment which is limited in space, and hence the total height thereof can be increased only within a limited range. Furthermore, intake manifolds are tightly arranged within the right and left banks constituted by the V-shaped deck cylinder parts, and considering that the V-type engine is transversely mounted, a space outside the right and left banks is also limited (since interference with peripheral equipment should be prevented).

On the other hand, regarding the V-type engine, the technology in which the axes of cylinders are offset from the center of a crankshaft has been proposed to make the engine compact as a whole. According to this technology, the axes of cylinders in respective banks are offset from the center of the crankshaft in the rotational direction of the crankshaft, and the banks are drawn along the axes of the cylinders to the center of the crankshaft, so that the distance between the center of the crankshaft and the bottom surfaces of the cylinders in the banks (i.e., the level of the cylinder surface) can be reduced to make the V-type engine compact (refer to Japanese Laid-Open Patent Publication No. 3-281901, for example).

However, if the banks are drawn along the axes of the cylinders to the center of the crankshaft, it is necessary to greatly modify many parts of an engine. Moreover, if the banks are drawn to the center of the crankshaft, the lower surfaces of the cylinders in one bank may enter into the cylinders in the other bank and interfere with connecting rods of the bank, and some measures must be taken to address this problem.

For this reason, the above technology has the problem that the V-type engine is considerably complicated in structure and requires high cost.

SUMMARY OF THE INVENTION

It is therefore an object of the present invention to provide a V-type engine which may increase the capacity of oil separation chambers while suppressing an increase in total height and total width by a simple construction and at low cost.

To attain the above object, there is provided a V-type engine, which includes a cylinder block formed with deck cylinder parts protruded in V-shape, and cylinder heads provided at respective heads of the deck cylinder parts, and in which the cylinder block is constructed such that the deck cylinder parts are offset in a direction identical with a rotational direction of a crankshaft, and oil separation chambers that separate oil from blow-by gas are provided at upper portion of the cylinder head displaced to a lower side by the offset.

With this arrangement, there is a difference in height between the oil separation chambers provided in different banks due to offsetting of the deck cylinder parts while the bank angle of the deck cylinder parts remains unchanged, so that a wide allowance can be secured in the axial direction of cylinders while an increase in the total width and total height of the V-type engine is suppressed. Therefore, if oil separation chambers, which carry out main oil separation, are provided at the cylinder head on the low deck side, the capacity of the oil separation chambers may be increased.

Preferably, the oil separation chambers are also provided at upper portion of the cylinder head displaced to a higher side by the offset, and the oil separation chambers on the lower side are longer in an axial direction of cylinders than the oil separation chambers on the higher side.

Therefore, even if the engine is constructed such that the oil separation chambers are provided in the respective deck cylinder parts, the capacity of the oil separation chambers which carry out main oil separation may be easily increased while suppressing an increase in the total height of the engine.

Preferably, among intake passages that lead intake air to the deck cylinder parts, a first air vent passage extending to an intake area located downstream across a throttle valve is connected to the oil separation chambers on the lower side.

With this arrangement, after oil content is sufficiently removed from blow-by gas using the oil separation chambers with an increased oil separation capability, the blow-by gas may be caused to flow back toward the intake side of the V-type engine, and hence it is possible to reduce the consumption of oil and purify exhaust gas. Moreover, oil pulled up by the crankshaft is inhibited from entering into the deck cylinder parts where the oil separation chambers with an increased oil separation capability are provided due to the relationship with the rotational direction of the crankshaft, and hence it is possible to further reduce the consumption of oil and purify exhaust gas.

Preferably, among the intake passages that lead intake air to the deck cylinder parts, a second air vent passage extending to an intake area located upstream across the throttle valve is connected to the oil separation chambers on the higher side.

With this arrangement, depending on the operative state of the engine, fresh air is led into the engine, or blow-by gas within the engine is caused to flow back toward the intake side of the engine through the oil separation chambers, and hence oil may be separated in an efficient manner.

Preferably, the oil separation chambers on the lower side are configured to cause blow-by gas generated inside the V-type engine in an overall operation range of the V-type engine to flow back toward intake ports, and the oil separation chambers on the higher side are configured to cause blow-by gas generated inside the V-type engine only during high-load operation of the V-type engine to flow back toward the intake ports.

Therefore, the use of the oil separation chambers on the lower side, which exhibit a high oil separation capability during low/intermediate load operation, which occurs frequently, may realize efficient oil separation, while an increase in the capacity of the oil separation chambers on the higher side which are used only in high load operation can be suppressed. Thus, both of the oil separation chambers and can be installed in manners suitable for respective intended purposes.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
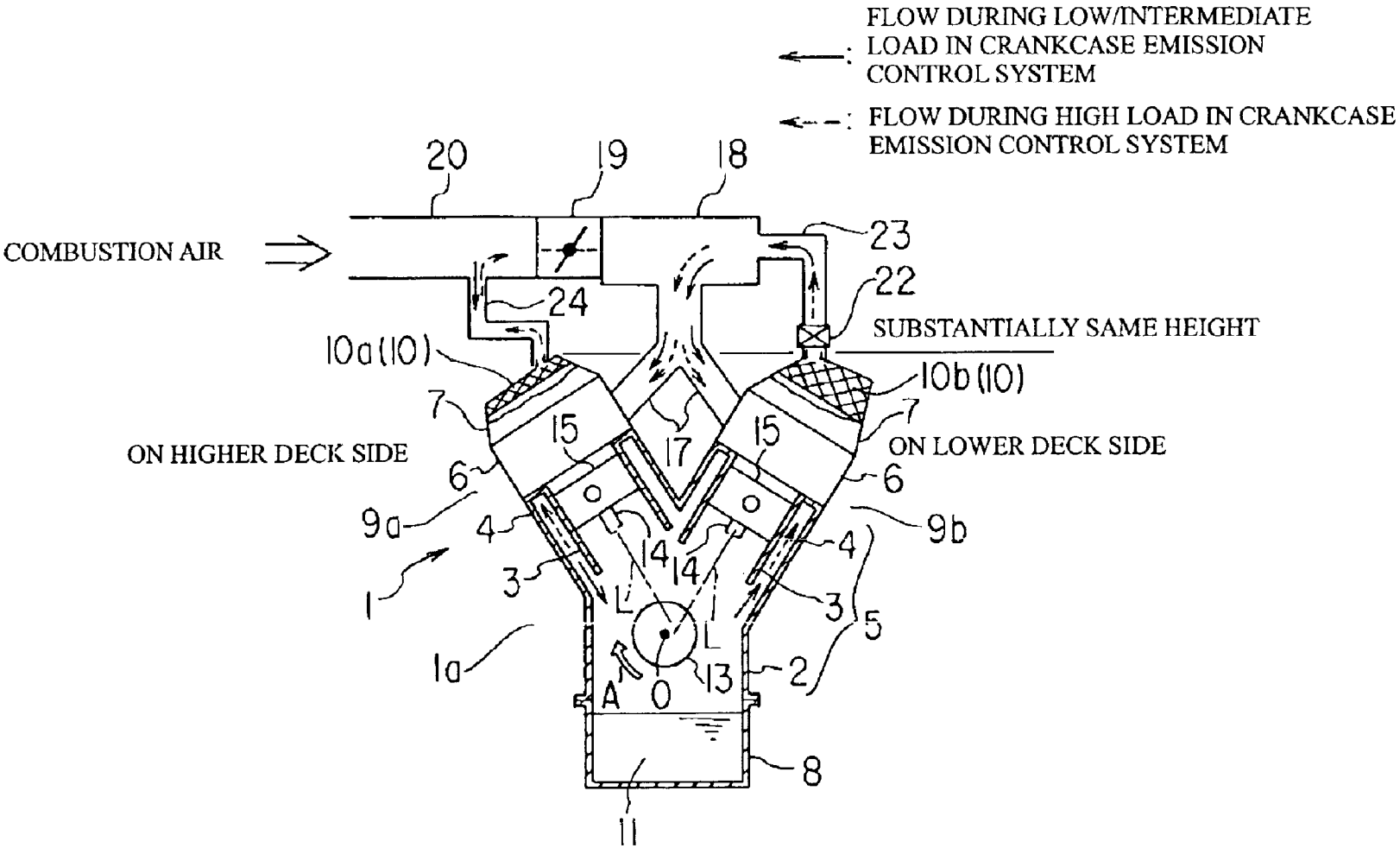
FIG. 1 is a sectional view showing a V-type engine according to an embodiment of the present invention.

A description will now be given of a V-type engine according to an embodiment of the present invention with reference to FIGS. 1 and 2.

A description will now be given of the construction of the V-type engine 1. As shown in FIGS. 1 and 2, an engine block 1*a* of the engine 1 is comprised mainly of a V-shaped cylinder block, i.e., a cylinder block 5 in which V-shaped deck cylinder parts 4 with cylinders 3 divided into predetermined cylinder banks are formed on the upper side of a common crankcase 2, cylinder heads 6 mounted on respective heads of the deck cylinder parts 4, rocker covers 7 as cover members mounted on the respective cylinder heads 6 to close openings at the heads thereof, and an oil pan 8 which covers an opening at the bottom of the crankcase 2.

The deck cylinder parts 4, cylinder heads 6, and rocker covers 7 constitute banks 9*a* and 9*b*, which are protruded in V-shape. Further, oil separation chambers 10 are provided on ceilings of the respective rocker covers 7. It should be noted that reference numeral 11 denotes lubricating oil accumulated in the oil pan 8.

A crankshaft 13 extending in the direction of the length of the engine 1, which is perpendicular to the axes of the cylinders 3, is rotatably supported in the crankcase 2. Pistons 15 housed in the respective cylinders 3 are rotatably connected to the crankshaft 13 via connecting rods 14.

The cylinder head 6 of each cylinder 3 has intake and exhaust valves, a valve system for the intake and exhaust valves, an ignition plug, and an injector, none of which is illustrated, incorporated therein. The operation of these component parts i.e., the operation of the piston 15, intake and exhaust valves, and ignition plug in predetermined timing realizes a combustion cycle comprised of an intake stroke, a compression stroke, an explosion stroke, and an exhaust stroke. An arrow A indicates a direction in which the crankshaft 13 is rotated during such an operation.

It should be noted that an intake passage 20, in which a ramiform intake manifold 17, a serge tank 18, and a throttle valve 19 are connected in this order, is connected to an intake port, not shown, formed on an inner side of each cylinder 6.

The banks 9*a* and 9*b* of the V-type engine 1 are offset in the same direction as the rotational direction of the crankshaft 13 (the direction indicated by the arrow A).

This will now be described in further detail. As shown in FIG. 2, a conventional engine (a V-type engine in which banks are not offset) is constructed such that the axes L1 of the cylinders 3 in the banks 9*a* and 9*b* are provided at such locations as to pass through the center O of the crankshaft 13. In FIG. 2, chain double-dashed lines indicate the outlines of the banks 9*a* and 9*b* on this occasion. In the offset V-type engine 1, while the deck height H represented by the length from the center O of the crankshaft 13 to the deck surface of the cylinder block 5 remains unchanged, the axes L1 of the deck cylinder parts 4 (the banks 9*a* and 9*b*) are moved parallel to the positions of axes L as offset points and in the same direction as the rotational direction (indicated by the arrow A) of the crankshaft 13 with respect to the center O of the crankshaft 13, so that the banks 9*a* and 9*b* are displaced (offset) as it is (with the bank angle thereof unchanged) in the same direction as the rotational direction of the crankshaft 13. $\delta$ indicates the offset distance on this occasion. It should be noted that in the present embodiment, the axes L of the cylinders 3 constituting the bank 9*a* are present within a flat surface parallel with the crankshaft 13. This is also the case with the bank 9*b*. The deck heights H of the respective banks 9*a* and 9*b* are set to be equal.

As a result of the above offset, the deck cylinder part 4 located in front (on the bank 9*b* side) in the rotational direction A of the crankshaft 13 has a smaller height in the vertical direction by C1 as compared with the conventional engine, and the deck cylinder part 4 located in rear (on the bank 9*a* side) has a greater height in the vertical direction by C2 as compared with the conventional engine. There is a large difference C(=C1+C2) in height between the cylinder heads 6 of both deck cylinder parts 4. It should be noted that C1 and C2 are represented by the following expression: SIN $(\theta/2)\times\delta$ where $\theta$ indicates the bank angle. For example, assuming that the bank angle $\theta$ is 60°, the height of the deck cylinder part 4 is changed by a value which is approximately half the offset distance $\delta$.

Specifically, in the engine block 1*a,* assuming that the deck height H is substantially equal, the offset gives a large allowance corresponding to the difference C in height in the vertical direction between the deck cylinder parts 4, which is substantially equal to the offset distance $\delta$, to the bank 9*b* located in front in the rotational direction of the crankshaft 13. Namely, the offset gives a large allowance in the axial direction of the cylinders 3 while an increase in the total width and total length of the engine block 1*a* is suppressed.

Figure 2:
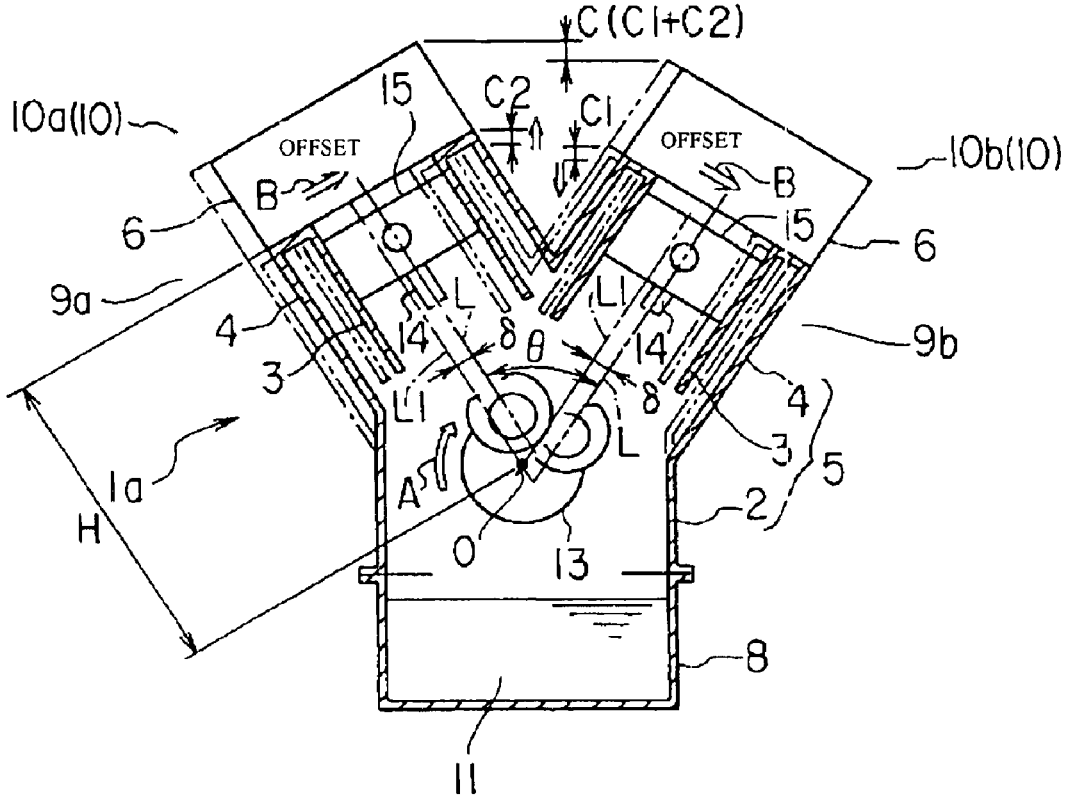
FIG. 2 is a sectional view useful in explaining how to offset deck cylinder parts of the V-type engine in FIG. 1.

Also, as indicated by a hatched area in FIG. 1, the oil separation chambers 10*b* are formed in a space that is increased in height (in the axial direction of the cylinder 3) by the allowance, so that the oil separation chambers 10*b* can be increased in capacity.

Here, in the present embodiment, the V-type engine 1 is constructed such that the oil separation chambers 10 are provided on both the low deck side and the high deck side. Considering the total height of the V-type engine 1, as shown in FIG. 1, the oil separation chambers 10*a* on the high deck side have a smaller height in the vertical direction by C2 to have a smaller capacity as compared with the conventional engine, while the oil separation chambers 10*b* on the low deck side are longer in the axial direction of cylinders as compared with the oil separation chambers 10*a*. More specifically, the oil separation chambers 10*b* on the low deck side have a greater height in the vertical direction by C to have a larger capacity than on the high deck side. Therefore, the capacity of the oil separation chambers 10*b* is increased while the total height of the V-type engine 1, which is substantially the same as the total height of the conventional engine, is maintained.

The oil separation chambers 10*b* with an increased capacity are intended to carry out oil separation in many ranges (in low, intermediate, and high load operation) during engine operation, and the oil separation chambers 10*a* with a reduced capacity are intended to carry out ventilation and oil separation in some ranges (in high load operation) during engine operation.

Further, in the engine block la illustrated in FIG. 1, the oil separation chambers 10*b* on the low deck side are in communication with e.g., a surge tank 18, which is disposed downstream of aft intake passage 20 across a throttle valve 19, via a PCV hose 23 (corresponding to a first air vent passage) provided with a PCV valve 22 (a positive crankcase ventilation: a part comprised of a one-way valve). Therefore, blow-by gas within the crankcase 2 is caused to flow back toward the intake side of the engine block 1*a* via the oil separation chambers 10*b*.

On the other hand, the oil separation chambers 10*a* on the high deck side are in communication with e.g., part of the intake passage 20 upstream of the throttle valve 19 via a breather hose 24 (corresponding to a second air vent passage). Therefore, depending on the operative state of the engine, flesh air is led into the crankcase 2, or blow-by gas within the crankcase 2 is caused to flow back toward the intake side of the engine block 1*a* via the oil separation chambers 10*b*.

As a result, the oil separation chambers 10*a* and 10*b* of the respective banks 9*a* and 9*b* constitute a crankcase emission control system that processes blow-by gas, which will now be described. Assuming that power is output from the crankshaft 13 due to reciprocating motions of the pistons 15 during operation of the V-type engine, blow-by gas containing unburned gas, which blows between the pistons 15 and the walls of the cylinders 3, flows into the V-type engine, i.e., the crankcase 2.

On this occasion, if the throttle valve 19 is opened at an angle (partial throttle angle) suitable for a low or intermediate load blow-by gas within the crankcase 2 is absorbed into the oil separation chambers 10*b* on the low deck side through blow-by passages, not shown, in the cylinder heads 6 and the rocker covers 7 as indicated by solid arrows in FIG. 1 due to intake negative pressure while oil content (engine oil) contained in the blow-by gas is separated. Then, the blow-by gas from which oil content has been separated is caused to flow back toward the intake ports of the cylinder heads 6 via the PCV valve 22 and the PCV hose 23, and is combusted in each cylinder 3.

On the other hand, since negative pressure within the crankcase 2 acts on blow-by passages, not shown, in the cylinder head 6 and the rocker covers 7 on the high deck side, flesh air is led into the blow-by passage via the breather hose 24 as indicated by solid arrows in FIG. 1. The flesh air ventilates the interior of the V-type engine 1 while the blow-by gas is processed.

On the other hand, if the throttle valve 19 is opened at an angle (full throttle angle) suitable for a high load, blow-by gas within the crankcase 2 is caused to flow back toward the intake ports of the cylinder head 6 through the oil separation chambers 10*b* on the low deck side due to negative intake pressure. At the same time, as indicated by broken arrows in FIG. 1, an ejector operation of intake air flow passed through an opening of the breather hose 24 causes the blow-by gas within the crankcase 2 to flow back toward the intake ports of the cylinder head 6, so that the blow-by gas is continuously processed. It should be noted that the separated oil content is returned to the oil pan 8 via oil passages, not shown, in various places of the V-type engine 1.

Therefore, the oil separation chambers 10*b* on the PVC hose 23 side, which are intended to carry out oil separation in low and intermediate load operation, which occurs frequently in the practical operation band, and high load operation, is required to have a higher oil separation capability as compared with the oil separation chambers 10*a* on the breather hose 24 side, which are intended to carry out oil separation only in high load operation which occurs with a low frequency.

As stated above, with such a simple and inexpensive construction that the oil separation chambers 10*b* are provided on the deck cylinder side lowered by offsetting, the capacity of the oil separation chambers 10*b* may be increased without affecting the total height and the total width of the V-type engine 1.

As a result, the oil separation capability of the oil separation chambers 10*b* may be increased without making the engine block 1*a* larger.

Furthermore, even in such an engine construction that the oil separation chambers 10*a* and 10*b* are incorporated in both decks, the oil separation chambers 10*b* required to have a high oil separation capability have a greater height than the oil separation chambers 10*a* on the high deck side, and hence the capacity of the oil separation chambers 10*b* on one side which are required to have a high oil separation capacity may be easily increased without increasing the total height of the engine 1.

In particular, in consideration of a difference in height due to offsetting, the oil separation chambers 10*a* on the high deck side have a smaller height than in the conventional engine, and the oil separation chambers 10*b* on the low deck side are increased in height to have the same height as the oil separation chambers 10*a*, and hence the oil separation chambers 10*b* which carry out main oil separation can be considerably increased while the total height of the engine 1 is kept substantially the same as the total height of the conventional engine, i.e. the engine 1 may be mounted easily as is the case with the conventional engine, and also the capacity of the oil separation chambers 10*a* which carry out sub oil separation may be reduced. Thus, both the oil separation chambers 10*a* and 10*b* may be installed in manners suitable for intended purposes.

Further, a PCV hose 29 extending downstream of the throttle valve 19 is connected to the oil separation chambers 10*b* on the low deck side, blow-by gas may be caused to flow back toward the intake side after oil content in the blow-by gas is removed by the oil separation chambers 10*b* with an increased separation capability, so that the consumption of oil can be reduced and exhaust gas may be purified.

Particularly, regarding blow-by gas, lubricating oil (mist) within the oil pan 8, which has been pulled up by the crankshaft 13, is likely to flow toward the oil separation chambers 10*a*, but the lubricating oil is unlikely to be pulled up toward the oil separation chambers 10*b* which carry out main oil separation due to the relationship with the rotational direction (indicated by the arrow A) of the crankshaft 13, and hence the lubricating oil (mist) directed toward the oil separation chambers 10*b* is suppressed, and the consumption of oil can be further reduced and exhaust gas can be further purified.

In addition, since the breather hose 24 extending upstream of the throttle valve 19 is connected to the oil separation chambers 10*a* on the high deck side, blow-by gas may be caused to flow back due to ventilation within the crankcase 2 using negative pressure during low/intermediate load operation, and also blow-by gas may be caused to smoothly flow back toward the intake side of the engine block 1*a* through the oil separation chambers 10*a* on the high deck side during high load operation. Therefore, oil may be reliably separated in an efficient manner.

Further, since the cylinders 3 are offset in the same direction as the rotational direction (indicated by the arrow A) of the crankshaft 13, such a known effect that thrust applied to the pistons 15 during an explosion stroke is reduced may also be obtained.

It should be understood that the present invention is not limited to the embodiment described above, but various changes in or to the above-described embodiment may be possible without departing from the spirits of the present invention.

For example, although in the above-described embodiment, the right and left banks are offset by the same offset distance, they may be offset by different offset distances insofar as engine performance is not affected.

We claim:

1. A V-type engine, comprising:

a cylinder block formed with deck cylinder parts protruded in V-shape; and cylinder heads provided at respective heads of said deck cylinder parts, said cylinder block being constructed such that the deck cylinder parts are offset in a direction identical with a rotational direction of a crankshaft; and oil separation chambers, that separate oil from blow-by gas, provided at upper portion of said cylinder head displaced to a lower side by the offset.

2. A V-type engine according to claim 1, wherein the oil separation chambers are also provided at upper portion of said cylinder head displaced to a higher side by the offset, and the oil separation chambers on the lower side are longer in an axial direction than the oil separation chambers on the higher side.

3. A V-type engine according to claim 2, wherein among intake passages that lead intake air to the deck cylinder parts, a first air vent passage extended to an intake area located downstream across a throttle valve is connected to the oil separation chambers on the lower side.

4. A V-type engine according to claim 3, wherein among the intake passages that lead intake air to the deck cylinder parts, a second air vent passage extended to an intake area located upstream across the throttle valve is connected to the oil separation chambers on the higher side.

5. A V-type engine according to claim 2, wherein the oil separation chambers on the lower side are configured to cause blow-by gas generated inside the V-type engine in an overall operation range of the V-type engine to flow back toward intake ports, and the oil separation chambers on the higher side are configured to cause blow-by gas generated inside the V-type engine only during a high-load operation of the V-type engine to flow back toward the intake ports.

* * * * *